US007073591B2

(12) United States Patent
Massie et al.

(10) Patent No.: US 7,073,591 B2
(45) Date of Patent: Jul. 11, 2006

(54) CASING HANGER ANNULUS MONITORING SYSTEM

(75) Inventors: Alfred Massie, Aberdeen (GB); Harry A. Moore, Houston, TX (US); Richard Lovell, Aberdeen (GB); Kevin G. Buckle, Aberdeen (GB); John H. Osborne, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 238 days.

(21) Appl. No.: 11/029,752

(22) Filed: Jan. 5, 2005

(65) Prior Publication Data

US 2005/0121199 A1 Jun. 9, 2005

Related U.S. Application Data

(63) Continuation of application No. 10/330,453, filed on Dec. 27, 2002, now abandoned.
(60) Provisional application No. 60/344,288, filed on Dec. 28, 2001.

(51) Int. Cl.
*E21B 34/04* (2006.01)
*E21B 33/043* (2006.01)

(52) U.S. Cl. ..... 166/348; 166/86.2; 166/87.1; 166/368; 166/386

(58) Field of Classification Search ..... 166/348, 166/368, 379, 386, 86.2, 87.1, 95.1, 97.1
See application file for complete search history.

(56) References Cited

U.S. PATENT DOCUMENTS 2,080,610 A * 5/1937 Humason ..... 166/87.1
2,360,041 A * 10/1944 Dale ..... 73/152.51
3,171,489 A * 3/1965 Cole et al. ..... 166/368
4,449,583 A * 5/1984 Lawson ..... 166/72
4,869,318 A * 9/1989 Kellett ..... 166/321
4,887,672 A * 12/1989 Hynes ..... 166/344
4,903,774 A * 2/1990 Dykes et al. ..... 166/363
5,143,158 A * 9/1992 Watkins et al. ..... 166/344
5,366,017 A * 11/1994 Voss, Jr. ..... 166/368
5,503,230 A * 4/1996 Osborne et al. ..... 166/344
5,544,707 A * 8/1996 Hopper et al. ..... 166/382
5,769,162 A * 6/1998 Bartlett et al. ..... 166/87.1
6,039,119 A * 3/2000 Hopper et al. ..... 166/368
6,186,237 B1 * 2/2001 Voss et al. ..... 166/337
6,302,212 B1 * 10/2001 Nobileau ..... 166/368
6,367,551 B1 * 4/2002 Fenton ..... 166/345
6,378,613 B1 * 4/2002 Kent et al. ..... 166/368
6,408,947 B1 * 6/2002 Cunningham et al. ..... 166/339
6,655,455 B1 * 12/2003 Bartlett et al. ..... 166/86.2
6,679,330 B1 * 1/2004 Compton et al. ..... 166/348
6,763,891 B1 * 7/2004 Humphrey et al. ..... 166/368

* cited by examiner

*Primary Examiner*—Hoang Dang
(74) *Attorney, Agent, or Firm*—Bracewell & Giuliani LLP

(57) ABSTRACT

A subsea wellhead assembly has the capabilities of communicating from a tree assembly mounted on an inner wellhead housing to a casing annulus. A passage in the wellhead assembly extends within the bore of the wellhead housing from the casing annulus to the tree assembly. A portion of the passage is located within a casing hanger. The passage is opened and closed by a valve. The valve does not open the passage until the tree assembly is connected to the wellhead housing and a tubing hanger orientation sleeve lands in the wellhead assembly. The tubing hanger orientation sleeve actuates the valve when it lands to open the passage. When the passage is opened, the casing annulus is in fluid communication with the interior surface of the wellhead housing, which is in communication with the tree assembly. The valve can be located in the casing hanger, or in a bridging hanger

16 Claims, 4 Drawing Sheets

CASING HANGER ANNULUS MONITORING SYSTEM

RELATED APPLICATIONS

Applicant claims priority to the application described herein through a United States provisional patent application titled "Casing Hanger Annulus Monitoring System," having U.S. Patent Application Ser. No. 60/344,288, which was filed on Dec. 28, 2001, and which is incorporated herein by reference in its entirety.

This application is a continuation of Ser. No. 10/330,453, filed Dec. 27, 2002 now abandoned.

BACKGROUND OF THE INVENTION

1. Technical Field

This invention relates in general to offshore drilling and production equipment, and in particular to a subsea well system for monitoring the pressure in a non-producing string of casing through the completion system.

2. Description of Related Art

A subsea well that is capable of producing oil or gas will have a conductor housing secured to a string of conductor pipe which extends some short depth into the well. A wellhead housing lands in the conductor housing. The wellhead housing is secured to an outer or first string of casing, which extends through the conductor to a deeper depth into the well. Depending on the particular conditions of the geological strata above the target zone (typically, either an oil or gas producing zone or a fluid injection zone), one or more additional casing strings will extend through the outer string of casing to increasing depths in the well until the well is cased to the final depth. Each string of casing is supported at the upper end by a casing hanger. The casing hanger lands in and is supported by the wellhead.

In some shallow wells and in some fluid injection wells, only one string of casing is set within the outer casing. Where only one string of casing is set within the outer casing, only one casing hanger, the production casing hanger, is landed in the wellhead housing.

The more typical case is where multiple strings of casing are suspended within the wellhead housing to achieve the structural support for the well to the depth of the target zone. Where multiple strings of casing hangers are landed in the wellhead housing, each casing hanger is above the previous one in the wellhead housing. Between each casing hanger and the wellhead housing, a casing hanger packoff is set to isolate each annular space between strings of casing. The last string of casing extends into the well to the final depth, this being the production casing. The strings of casing between the outer casing and the production casing are intermediate casing strings.

When drilling and running strings of casing in the well, it is critical that the operator maintains pressure control of the well. This is accomplished by establishing a column of fluid with predetermined fluid density inside the well. During drilling operations, this fluid is circulated down into the well through the inside of the drillstring out the bottom of the drillstring and back to the surface. This column of density-controlled fluid balances the downhole pressure in the well. When setting casing, the casing is run into the pressure balanced well. A blowout preventer system is employed during drilling and running strings of casing in the well as a further safety system to insure that the operator maintains pressure control of the well. The blowout preventer system is located above the wellhead housing by running it on drilling riser to the wellhead housing.

When each string of casing is suspended in the wellhead housing, a cement slurry is flowed through the inside of the casing, out of the bottom of the casing, and back up the outside of the casing to a predetermined point. An open fluid communication passage in the casing hanger leading from the casing annulus to the casing interior would adversely affect the flow path of the cement slurry. This could also cause well pressure control problems for the operator under certain conditions.

In a subsea well capable of producing oil or gas, the production fluids flow through perforations made in the production casing at the producing zone. A string of tubing extends to the producing zone within the production casing to provide a pressure controlled conduit through which the well fluids are produced. At some point above the producing zone, a packer seals the space between the production casing and the tubing to ensure that the well fluids flow through the tubing to the surface. The tubing is supported by a tubing hanger assembly that lands and locks above the production casing hanger, either in the wellhead housing, in a tubing hanger spool, or in a horizontal or spool tree, as described below.

Subsea wells capable of producing oil or gas can be completed with various arrangements of the production control valves in an assembly generally known as a tree. For wells completed with a conventional tree, the tubing hanger assembly lands in the wellhead housing above the production casing hanger. Alternatively, the tubing hanger assembly lands in a tubing hanger spool that is itself landed and locked to the wellhead housing. For wells completed with a horizontal or spool tree, the horizontal tree lands and seals on the wellhead housing. A tubing hanger assembly lands and seals in the horizontal tree. The tubing hanger assembly in conventional trees has a flow passage for communication with the annulus surrounding the tubing. A tubing annulus bypass extends around the tubing hanger in horizontal trees. These passages allow for communication between the interior of the production casing and the interior of the tubing. Virtually all producing wells are capable of monitoring pressure in the annulus flow passage between the interior of the production casing and the interior of the tubing.

A sealed annulus locates between the production casing and the next larger string of casing. Normally there should be no pressure in the annulus between the production casing and the next larger string of casing because the annular space between the production casing and the next larger string of casing is ordinarily cemented at its lower end and sealed with a packoff at the production casing hanger end. If pressure within this annulus increases, it would indicate that a leak exists in one of the strings of casing. The leak could be from several places. Regardless of where the leak is coming from, pressure build up in the annulus between the production casing and the next larger string of casing could collapse a portion of the production casing, compromising the structural and pressure integrity of the well. For this reason, operators monitor the pressure in the annulus between the production casing and the next larger string of casing in land-based or above water wells. Monitoring production casing annulus pressure in a subsea well is more difficult because of lack of access to the wellhead housing below the production casing hanger packoff. Patents exist that show different methods for monitoring the annulus pressure between the production casing and the next larger casing in subsea wells.

SUMMARY OF THE INVENTION

In a subsea well assembly a tubular wellhead member or wellhead housing having a bore registers with a tree assembly. A casing hanger that has a bore lands in the bore of the wellhead member. The casing hanger is adapted to be secured to a string of casing, which defines a casing annulus. A passage extends from the casing annulus into the wellhead member above the casing hanger. There is also a valve in the well assembly that selectively opens and closes the passage. The well assembly also includes a tubing hanger assembly that lands in the bore of the wellhead member. The tubing assembly is adapted to be connected to a string of tubing. The tubing hanger assembly has a portion that engages the valve while landing to move the valve from a closed position to an open position.

In the first embodiment, a portion of the passage extends through a production casing hanger from the exterior of the production casing hanger below the casing hanger packoff to an outlet in the interior of the production casing hanger. A port closure sleeve threads to the interior of the production casing hanger. The port closure sleeve seals on both sides of the passage outlet in the interior of the production casing hanger. With the port closure sleeve as described, the passage between the exterior of the production casing hanger and the bore of the production casing is isolated. The port closure sleeve is removed before the tree assembly is installed. After the removal, a ported production bridging hanger lands on top of and in the casing hanger. The ported production bridging hanger mates and seals on its exterior surface with the interior of the production casing hanger at a point above and below the passage outlet in the interior of the production casing hanger. Another portion of the passage extends through the bridging hanger, between a pair of seals, to an inlet of the valve for opening and closing the passage.

The valve is reciprocally mounted in the bridging hanger and is in a closed position until a tubing hanger assembly is installed. When the tubing hanger assembly is installed, the base of the tubing hanger assembly presses against the valve. When the tubing hanger assembly is in its final position, the springs in the valve are compressed, thereby opening the passage running through the bridging hanger. The annulus pressure then communicates through the passage to the exterior of the tree assembly. A communication line extends from the tree to monitoring equipment at the surface for monitoring the pressure in the annulus of the production casing as described.

In the second embodiment, the passage includes a valve passage, a slot, and a port that are located in the casing hanger. The valve passage leads from the interior edge of the production casing hanger flowby slot, which in turn opens into the production casing annulus. The valve passage leads upward into the bore of the casing hanger. A spring-loaded valve is reciprocally carried in the valve passage. The valve protrudes into the casing hanger bore while in a closed position. The casing annulus does not communicate to the port until the tubing hanger assembly is installed because the valve remains in a closed position until the tubing hanger assembly is installed.

When the tubing hanger assembly is installed, the tubing hanger assembly comes into contact and presses against the valve. When the tubing hanger assembly has been installed, the valve moves downward opening the valve passage. From the port, the annulus pressure communicates to the tree assembly for monitoring the pressure in the annulus of the production as described.

DETAILED DESCRIPTION OF THE PREFERRED EMBODIMENT

Figure 1:
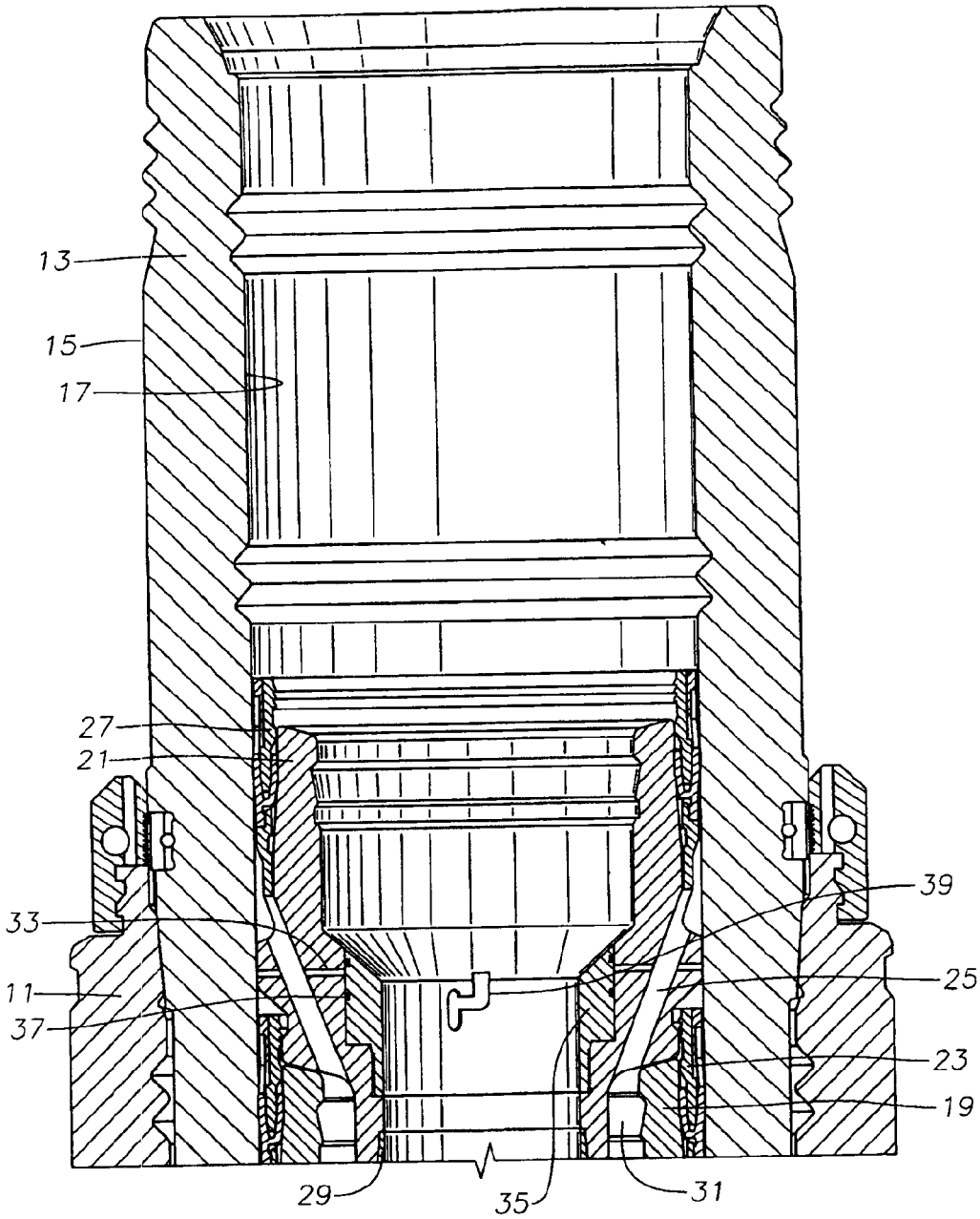
FIG. 1 is an overall sectional view of an upper portion of a wellhead assembly in accordance with this invention and shown with a production casing hanger installed, but before a tree assembly had been attached.

Referring to FIG. 1, one configuration for the subsea wellhead assembly includes a conductor housing 11, which will locate at the sea floor. Conductor housing 11 is a large tubular member that is secured to a string of conductor pipe (not shown). Conductor pipe (not shown) extends to a first depth into the well. A tubular wellhead member or wellhead housing 13 lands in the conductor housing 11. Wellhead housing 13 is typically a high pressure tubular member having an exterior surface 15 and an interior surface 17. Wellhead housing 13 secures to a first string of casing, which extends through the conductor pipe (not shown) to a deeper depth into the well. Normally, the first string of casing (not shown) is cemented in place.

Typically, an intermediate casing hanger 19 and intermediate casing (not shown) are installed in wellhead housing 13 in the first string of casing. Intermediate casing hanger 19 lands on a lower shoulder located on interior surface 17 of the wellhead housing 13. In the preferred embodiment, an intermediate casing hanger packoff 23 seals intermediate casing hanger 19 with interior surface 17 of the wellhead housing 13. Intermediate casing hanger 19 secures to a string of intermediate casing (not shown), which is cemented in place. Intermediate casing (not shown) extends between the first string of casing (not shown) and production casing 29 to an intermediate depth.

In the preferred embodiment, a production casing hanger or casing hanger 21 having an interior surface and an exterior surface lands on a shoulder on intermediate casing hanger 19. A production casing hanger packoff 27 seals casing hanger 21 with interior surface 17 of wellhead housing 13. A production casing 29 attaches to a lower portion of casing hanger 21. Production casing 29 extends through the intermediate string of casing (not shown) to a final depth of the well. Production casing 29 is cemented in place.

A production casing annulus or casing annulus 31 is in the space surrounding the production casing 29. In the preferred embodiment, casing annulus 31 surrounds casing hanger 21, and packoff 27 prevents leakage past casing hanger 21. Normally, there would be only nominal, atmospheric pressure in casing annulus 31. Preferably, only a lower portion of production casing 29 is exposed to well pressure, which is through perforations (not shown). Cement in production annulus 31 blocks communication of formation pressure from the perforations. In the preferred embodiment, a packer (not shown) locates in production casing 29 above these perforations to seal the well pressure within the lower portion of production casing 29. In the preferred embodiment, pressure other than atmospheric is in casing annulus 31 only when a leak occurs.

Casing annulus pressure communicates through a passage. In the preferred embodiment, there is a casing portion of the passage, which includes a communication passage or port 33 that extends laterally through a side of casing hanger 21 from its exterior surface to its interior surface. In the preferred embodiment, port 33 is located at an axial position between packoffs 23 and 27. Port 33 intersects a flowby for cement return passage or slot 25 in casing hanger 21. Typically, slot 25 extends from casing annulus 31 to the exterior surface of casing hanger 21 between packoffs 23 and 27. Packoffs 23 and 27 block communication of casing annulus pressure both up and down interior surface 17 of wellhead housing 13 adjacent slot 25. Port 33 allows fluid communication between the casing annulus 31 and the interior surface of casing hanger 21.

While pumping cement down the casing, cement returns through flowby slots 25 and does not enter the bore of casing hanger 21. Fluid communication between the interior surface and the exterior surface of casing hanger 21 is not desired when production casing 29 is being installed. In the preferred embodiment, a port closure sleeve 35 with upper and lower seals 37 seal port 33. Seals 37 extend around closure sleeve 35 and locate above and below port 33. In the preferred embodiment, port closure sleeve 35 is threadedly connected to casing hanger 21 before casing hanger 21 is run. Port closure sleeve 35 has an interior surface and an exterior surface. A slot 39 in the interior surface of port closure sleeve 35 allows a tool (not shown) to be lowered from the surface to unscrew the port closure sleeve 35 from the casing hanger 21 and remove the port closure sleeve 35 prior to installing a tree assembly (not shown), prior to running tubing.

Figure 2:
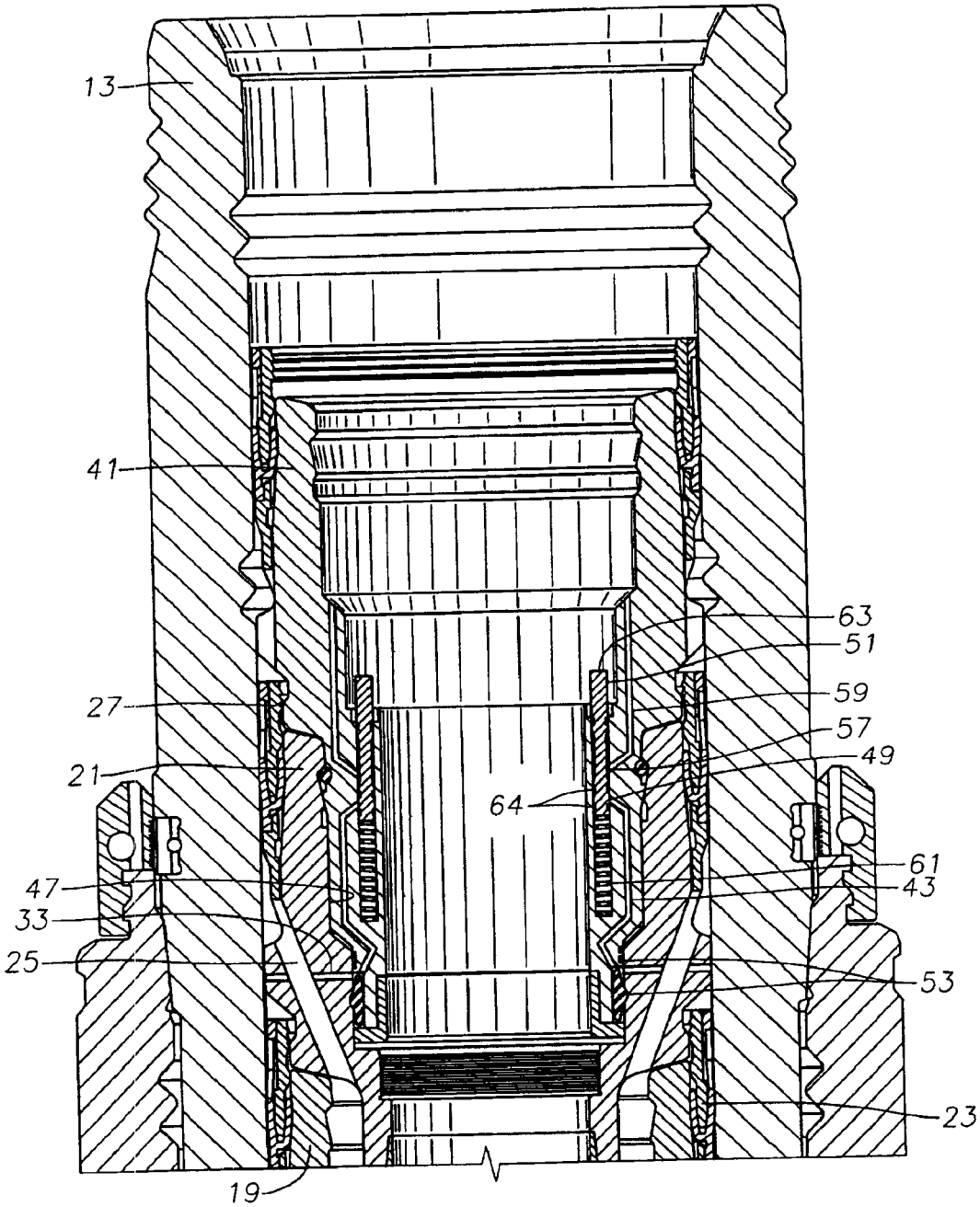
FIG. 2 is an overall sectional view of the wellhead assembly of FIG. 1, after the port closure sleeve has been removed and a ported production bridging hanger has been installed, but before a tubing hanger assembly has been installed.

Referring to FIG. 2, a ported production bridging hanger or bridging hanger 41 is lowered into the well after the port closure sleeve 35 has been removed, until the base of the bridging hanger 41 lands on casing hanger 21. In the preferred embodiment, there is a bridging portion of the passage, which includes a lower bridging passage 43 and an upper bridging passage 59. In the preferred embodiment, lower bridging passage 43 communicates with port 33 and extends from an exterior surface of bridging hanger 41 that is engaging the interior surface of casing hanger 21 to a valve 51 positioned in bridging hanger 41. In the preferred embodiment, upper bridging passage 59 extends from valve 51 to a surface of bridging hanger 41 that is in fluid communication with interior surface 17 of wellhead housing 13. Typically, an interior surface of bridging hanger is the surface of bridging hanger 41 that is in fluid communication with interior surface 17 of wellhead housing 13. Lower and upper bridging passages 43, 59 are in fluid communication when valve 51 is in an open position, and valve 51 blocks communication when in a closed position. Preferrably, port 33 aligns with the entrance to lower bridging passage 43 when bridging hanger 41 is installed. The inlet to passage 43 may extend completely around bridging hanger 41 to avoid having to orient bridging hanger 41. A set of seals 53 sealingly engages the interior surface of production casing hanger 21 and the exterior surface of bridging hanger 41 above and below port 33. The casing annulus pressure communicates from port 33 into the lower bridging passage 43.

Figure 3:
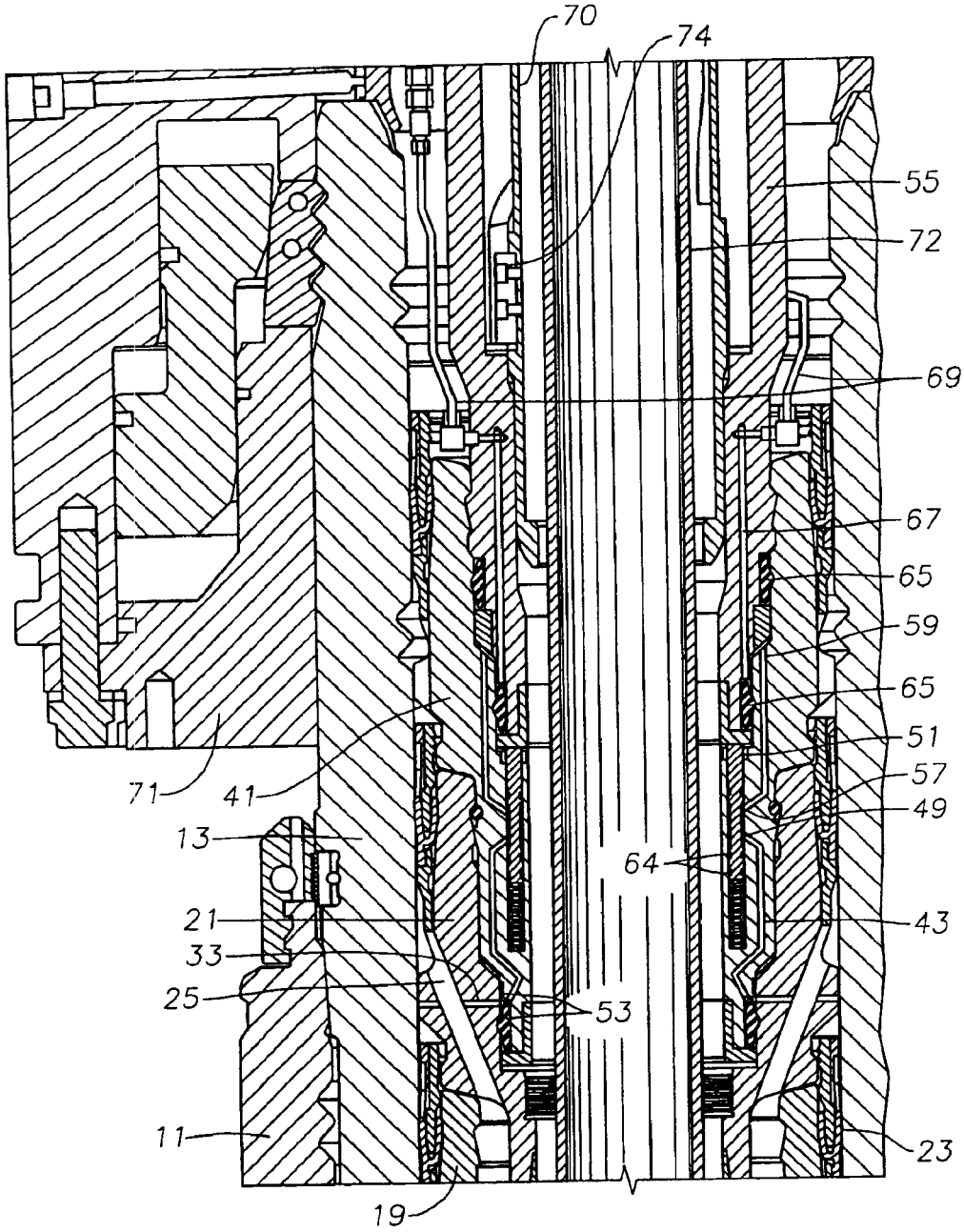
FIG. 3 is an overall sectional view of the wellhead assembly of FIG. 1, after the tubing hanger assembly has been installed.

The annulus pressure communicates vertically through the lower bridging passage 43 to an inlet 49 of a bridging hanger valve 51. A set of seals 64 located on valve 51 engage bridging hanger 41. As shown in FIG. 2, valve inlet 49 is closed and seals 53 above and below port 33 prevent upward communication of casing annulus pressure 31 when valve 51 is in its closed position. As shown in FIG. 3, the annulus pressure communicates through inlet 49 and proceeds out a valve outlet 57 into the upper bridging passage 59 when valve 51 is in its open position.

Valve 51 includes a cylindrical rod 63 that is reciprocally and sealingly carried in a bore that extends axially downward from the top of bridging hanger 41. Valve 51 includes a valve spring 61 that is preferably located in the bore that valve 51 is positioned within, and which applies a force on cylindrical rod 63. The upper end of rod 63 extends above the interior surface of bridging hanger 41 while in the closed position. Seals 64 located around rod 63 block flow between lower and upper bridging passages 43, 59 while valve 51 is in its upper position. Valve 51 is in its closed position in FIG. 2 because valve spring 61 pushes valve 51 to the closed position until enough force is applied to the top of valve rod 63 to open valve 51 by compressing valve spring 61. When this occurs, rod 63 moves downward, positioning seals 64 below the junction between the communication passages 43 and 59.

Referring to FIG. 3, valve 51 is in the open position. Valve 51 opens when a tubing hanger orientation sleeve 55 is lowered into wellhead 13, which compresses valve spring 61 until orientation sleeve 55 lands on the top of bridging hanger 41. Tubing hanger orientation sleeve 55 is considered herein to be a lower component of a tubing hanger assembly that also includes, but is not limited to, a tubing hanger 70 (lower portion shown) and a string of tubing 72. Tubing hanger orientation sleeve 55 is secured to the lower end of a tree 71 (lower connection portion shown). Tubing hanger orientation sleeve 55 has an interior helical cam (not shown) and slot (not shown) that mates with a tubing hanger alignment pin assembly 74 for aligning tubing hanger 70 with tree 71. Tubing hanger 70 lands, locks, and seals in tree 71. Tubing hanger 70 rotates to proper orientation by the interaction of pin assembly 74 and the slot on orientation sleeve 55 as tubing hanger 70 lands.

With valve 51 in the open position, casing annulus 31 communicates through valve 51 and into upper bridging passage 59. In the preferred embodiment, upper bridging passage 59 extends above valve 51 substantially vertically through bridging hanger 41 and opens into a space between the interior of the bridging hanger 41 and the exterior of the tubing hanger orientation sleeve 55. Seals 65 are located between interior of the bridging hanger 41 and the exterior of the tubing hanger orientation sleeve 55. In the preferred embodiment, there is a tubing hanger portion of the passage, which includes a tubing hanger passage 67 that extends through tubing hanger orientation sleeve 55. In the preferred embodiment, tubing hanger passage 67 extends from an exterior surface on its lower portion to the exterior surface on its upper portion that is in communication with interior surface 17 of wellhead housing 13. Seals 65 force casing annulus 31 to communicate with tubing hanger passage 67. In the preferred embodiment, tubing hanger passage 67 runs substantially vertically through the tubing hanger orientation sleeve 55 and then turns toward and opens up at the exterior surface of tubing hanger orientation sleeve 55. In the preferred embodiment, a communication line 69 connects to the exterior of tubing hanger orientation sleeve 55 and is in communication with passage 67. Communication line 69 proceeds through tree assembly 71 for monitoring in a manner known by those with skill in the art.

In operation, the well will be drilled and cased as shown in FIG. 1. Port closure sleeve 35 blocks casing annulus port 33 during these operations. A riser and BOP (not shown) connect to the wellhead housing 13 during these operations.

Then a retrieval tool (not shown) is lowered through the BOP and the riser to latch into port closure sleeve 35 and remove it, as shown in FIG. 2. The operator then runs the bridging hanger 41 through the BOP and riser, and lands the bridging hanger 41 as shown in FIG. 2. Valve 51 will be in the closed position. The operator then removes the riser and BOP from wellhead 13 and lowers the tree. The tubing hanger orientation sleeve 55 will be attached to the lower end of tree 71 as it is being run. Tree 71 lands on and connects to the wellhead housing 13. At the same time, the tubing hanger orientation sleeve 55 depresses valve 51, thereby opening communication passages 43, 59. Any pressure that might exist in casing annulus 31 is controlled through valves in tree 71 and the tree running string. Production tubing 72 is then run through the riser and tree 71, with tubing hanger 70 landing in tree 71. Pin assembly 74 engages orientation sleeve 55 to rotate tubing hanger 70 to a position with its production outlet aligned with the production outlet of tree 71.

Figure 4:
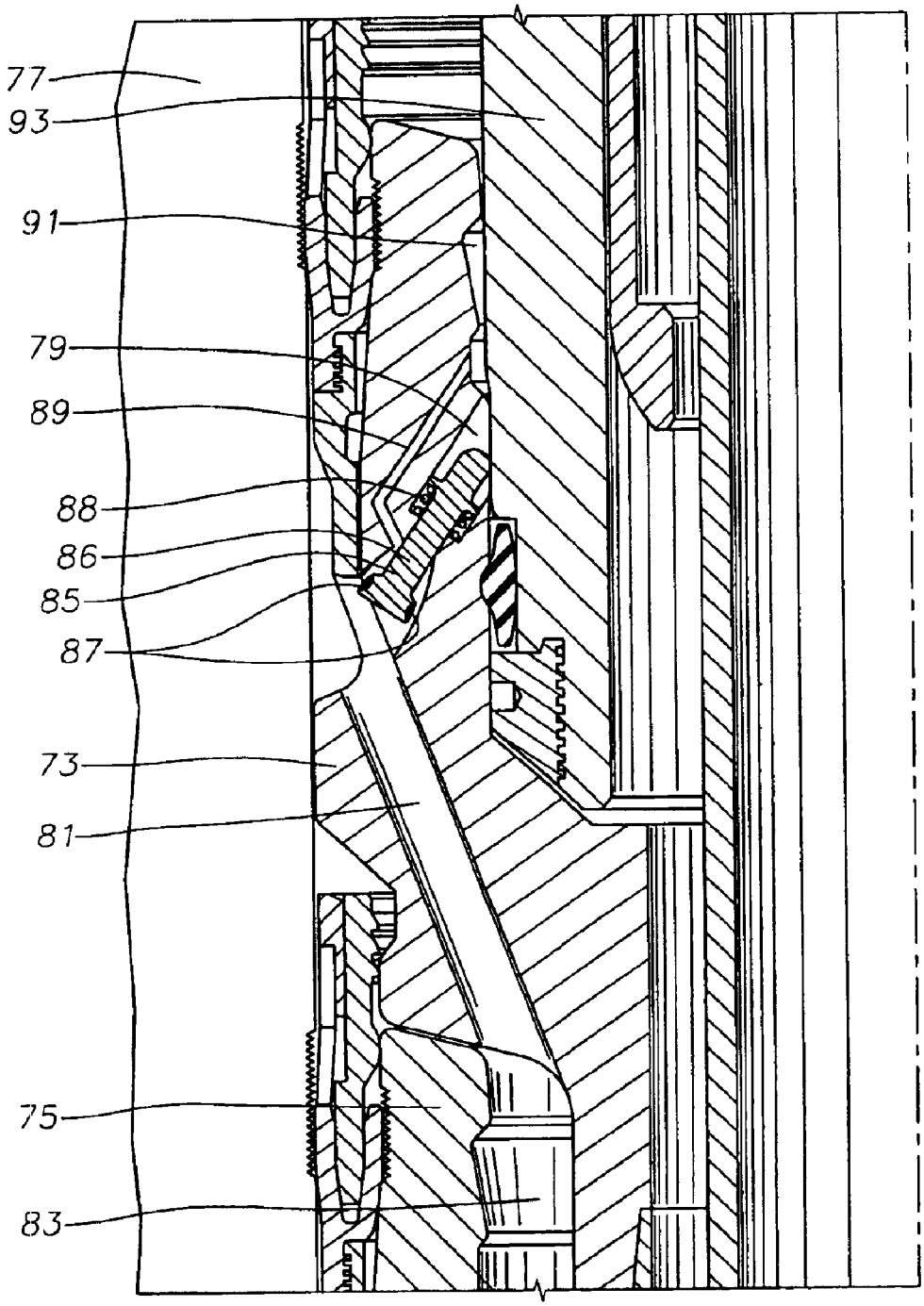
FIG. 4 is a sectional view of the wellhead assembly of a second embodiment of the invention, after a tubing hanger assembly has been installed.

In the second embodiment, as shown in FIG. 4, a production casing hanger 73 lands on an intermediate casing hanger 75 within a tubular wellhead member or wellhead housing 77. In this embodiment, the casing hanger portion of the passage includes a valve passage 79, a flowby slot 81, and a port 89. Valve passage 79 is located in casing hanger 73 and preferably extends diagonally downward from the interior of casing hanger 73 to an upper portion of flowby slot 81. Flowby slot 81 extends through casing hanger 73 with a lower portion that opens into a casing annulus 83. The production casing annulus pressure communicates from the casing annulus 83, through slot 81, and into the valve passage 79.

A valve 85 is reciprocally mounted in the annulus valve passage 79. Valve 85 comprises a rod 86 having seals 87 that sealingly engage the surface of valve passage 79 and a spring 88 that urges rod 86 upward. While in a closed position (not shown in FIG. 4), rod 86 extends into the interior of the production casing hanger 73. Valve 85 is closed because seals 87 on the exterior of the base of the valve 85 are in contact with the walls of the annulus valve passage 79. Port 89 extends from annulus valve passage 79 to the interior surface of casing hanger 73. In the preferred embodiment, port 89 extends from the interior of annulus valve passage 79 for a short distance, then turns and extends substantially alongside annulus valve passage 79, and opens into an annular space 91 around a tubing hanger orientation sleeve 93. Annular space 91 is in fluid communication with the interior surface of wellhead housing 77. When orientation sleeve 93 lands in the bore of casing hanger 73, orientation sleeve 93 moves valve 85 to the open position.

Port 89 connects to valve passage 79 farther away from slot 81 than the surface of valve passage that seals 87 engage when in the closed position. Therefore, when valve 85 is closed, the production casing annulus pressure does not communicate beyond seals 87. But when valve 85 is open, as shown in FIG. 4, the production casing annulus pressure communicates through flowby slot 81, into annulus valve passage 79, around seals 87, through port 89, and into annular space 91 that is in fluid communication with the interior surface of wellhead housing 77. The tree in this embodiment monitors the casing annulus pressure from the interior surface of wellhead housing 77.

In operation of the second embodiment, production casing hanger 73 is installed onto intermediate casing hanger 75 inside of wellhead housing 77. As installed, valve 85 is in a closed position, blocking communication from casing annulus 31. Unlike the first embodiment where port closure sleeve 35 (FIG. 1) must be removed, valve 85 is automatically opened when the exterior of tubing hanger orientation sleeve 93 is installed and pushes down against valve 85, so that seals 87 are no longer in contact with the interior surface valve passage 79. Orientation sleeve 93 is installed as in the first embodiment, by attaching it to the lower end of the tree and landing the tree on the wellhead housing 77. An advantage of the second embodiment is that there is no need to retrieve a closure sleeve and install a bridging hanger before running the tree because valve 85 in the production casing hanger 73 is opened automatically by the tubing hanger orientation sleeve 93 pushing open valve 85 during installation. An advantage of the first embodiment is the protection provided to the casing hanger bore by closure sleeve 35 prior to removing it.

In both embodiments, the casing annulus is at all times under safety control. In the first embodiment, when closure sleeve 35 (FIG. 1) is removed and prior to landing ported bridging hanger 41 (FIG. 2), the casing annulus monitoring passage is open. However, the BOP and riser will be in place during this time for safety, since bridging hanger 41 is run through the BOP and riser prior to running the tree. In the second embodiment, the casing annulus monitoring passage opens only when the tree and orientation sleeve lands.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein or in the steps or in the sequence of steps of the methods described herein without departing from the spirit and the scope of the invention as described. For example, although both embodiments disclose a tubing hanger that lands in a production tree, the invention would also work with tubing hangers that land in the wellhead housing on in a tubing spool above the wellhead housing.

What is claimed is:

1. A subsea wellhead assembly comprising:

a tubular wellhead member having a bore, the wellhead member being adapted to register with a tree assembly;

a casing hanger adapted to be secured to a string of casing defining a casing annulus, the casing hanger landing in the bore of the wellhead member;

a passage extending from the casing annulus into the wellhead member above the casing hanger;

a normally closed valve that opens and closes the passage; and a lower component of a tubing hanger assembly that lands in the bore of the wellhead member and engages the valve while the lower component is landing to move the valve from a closed position to an open position.

2. The subsea wellhead assembly of claim 1, further comprising a spring located within the valve that actuates the valve to close the passage.

3. The subsea wellhead assembly of claim 2, wherein the spring expands in order to actuate the valve to close the passage, and the tubing hanger assembly opens the passage when the tubing hanger assembly engages the valve by compressing the spring.

4. The subsea wellhead assembly of claim 1, further comprising a seal extending around the casing hanger that engages the bore of the wellhead member, the seal blocking upward communication from the casing annulus other than through the passage.

5. The subsea wellhead assembly of claim 1, wherein the passage extends from the casing annulus through the casing hanger to a bore of the casing hanger.

6. The subsea wellhead assembly of claim 1, further comprising a bridging hanger that has a lower portion landing in a bore of the casing hanger; and wherein the passage has a lower bridging portion extending through the lower portion of the bridging hanger and communicating with the wellhead member above the casing hanger.

7. The subsea wellhead assembly of claim 6, wherein the passage has a casing portion that extends from the casing annulus through the casing hanger to the bore of the casing hanger, the casing portion being in communication with the lower bridging portion.

8. The subsea wellhead assembly of claim 1, further comprising a bridging hanger that lands on the casing hanger; and wherein the valve is located in the bridging hanger.

9. The subsea wellhead assembly of claim 8, wherein the passage has a lower bridging portion extending from the casing annulus through the bridging hanger to the valve, and an upper bridging portion extending from the valve through the bridging hanger into the wellhead member above the casing hanger.

10. The subsea wellhead assembly of claim 1, wherein the passage extends from the casing annulus through the casing hanger to a bore of the hanger, and the valve is located within the casing hanger.

11. A method for communicating with a casing annulus in a wellhead assembly comprising the following steps:

(a) providing a casing hanger in a bore of a tubular wellhead member, a casing annulus formed around a string of casing hanging from the casing hanger, and a passage that is in fluid communication with the casing annulus and the bore of the wellhead member; then (b) locating a valve in the wellhead member and closing the passage with the valve; then (c) cooperatively landing a lower component of a tubing hanger assembly in the bore of the wellhead member, engaging the valve with the lower component, and moving the valve from the closed position to an open position.

12. The method of claim 11, wherein step (c) comprises connecting a tubing hanger orientation sleeve to a tree assembly, and landing the tree assembly on the wellhead member.

13. The method of claim 11, wherein step (b) comprises spring-biasing the valve to the closed position.

14. The method of claim 11, wherein step (b) comprises:

providing a bridging hanger, the passage having at least a portion in the bridging hanger; then locating the valve in the bridging hanger; then landing the bringing hanger in the bore of the wellhead member.

15. A subsea wellhead assembly comprising:

a tubular wellhead housing having a bore, the wellhead housing being adapted to register with a tree assembly;

a casing hanger adapted to be secured to a string of casing defining a casing annulus, the casing hanger landing in the bore of the wellhead housing;

a casing annulus passage extending through a sidewall of the casing hanger from the casing annulus into the wellhead housing above the casing hanger;

a barrier within the casing annulus passage that has an initial configuration blocking flow through the casing annulus passage; and the barrier being movable without being retrieved to open the casing annulus passage to allow monitoring of pressure within the casing annulus.

16. A method for communicating with a casing annulus in a wellhead assembly comprising the following steps:

(a) providing a casing hanger in a bore of a tubular wellhead member, a casing annulus formed around a string of casing hanging from the casing hanger, and a casing annulus passage in a sidewall of the casing hanger that is in fluid communication with the casing annulus and the bore of the wellhead member;

(b) locating a barrier in the casing annulus passage, the barrier having an initial configuration that blocks flow through the casing annulus passage; then (c) without retrieving the barrier, moving the barrier from the initial configuration to open the casing annulus passage.

* * * * *

UNITED STATES PATENT AND TRADEMARK OFFICE

CERTIFICATE OF CORRECTION

PATENT NO. : 7,073,591 B2
APPLICATION NO. : 11/029752
DATED : July 11, 2006
INVENTOR(S) : Alfred Massie et al.

It is certified that error appears in the above-identified patent and that said Letters Patent is hereby corrected as shown below:

Column 8, line 45, delete "on" before "in a tubing" and insert therefor --or--

Column 10, line 14, delete "bringing" and insert therefor --bridging--

Signed and Sealed this

Twenty-eighth Day of November, 2006

JON W. DUDAS
*Director of the United States Patent and Trademark Office*